United States Patent [19]

Glennon

[11] 4,425,513

[45] Jan. 10, 1984

[54] METHOD AND DEVICE FOR PROVIDING DWELL IN TIMER CONTROLLED APPLIANCES

[75] Inventor: Thomas F. Glennon, Chicago, Ill.

[73] Assignee: Eation Corporation, Cleveland, Ohio

[21] Appl. No.: 349,111

[22] Filed: Feb. 16, 1982

[51] Int. Cl.[3] ..... H01H 3/34

[52] U.S. Cl. ..... 307/141.4; 307/143

[58] Field of Search ..... 307/140, 141.4, 143; 134/57 R, 58 R; 368/10; 315/360, 362; 361/23, 59, 71, 73, 75, 196, 119

[56] References Cited

U.S. PATENT DOCUMENTS 4,008,415 2/1977 De Avila-Serafin et al. ... 315/360 X
4,213,058 7/1980 Townsend ..... 307/141.4 X
4,280,063 7/1981 Yokomori et al. ..... 307/141.4
4,336,464 6/1982 Weber ..... 307/141.4
4,349,748 9/1982 Goldstein et al. ..... 301/143 X

*Primary Examiner*—Patrick R. Salce
*Assistant Examiner*—D. Jennings
*Attorney, Agent, or Firm*—C. H. Grace; R. A. Johnston

[57] ABSTRACT

The accumulated number of cycles of an alternating current power supply are counted and a first signal is generated when the count reaches a number representing a desired time lapse and a second signal is generated when a desired multiple of a number have been counted. The timing motor of an electro-mechanical appliance programmer is switched off by said first signal and remains off for a time interval of twice that represented by a second signal.

6 Claims, 3 Drawing Figures

CLOCK LINE
IC1
Q11
Q12
VDD
VSS
R1
R2
R4
R5
C1
C2
D1
D2
D3
D4
D5
Q1
Q2
T1
T2
T3
T4
S1
L1
L2
60~
120V
TIME: SECONDS
TIMER MOTOR ON
ELAPSED TIME: SECONDS
0
17
34
51
68
Δt
Q12
Q11

METHOD AND DEVICE FOR PROVIDING DWELL IN TIMER CONTROLLED APPLIANCES

BACKGROUND OF THE INVENTION

The present invention relates to control systems for appliances having a time controlled program cycle and in particular relates to domestic washing appliances such as dishwashers and clothes washers.

In providing cycle control systems for such appliances, it is known practice to employ electro-mechanical programmers employing a synchronous timing motor to drive an electrical programmer comprising series of ratchets or cam actuated devices for opening and closing sets of suitable electrical contacts for controlling the various functions of the machine in accordance with a predetermined program cycle. In the presently commercially available versions of such appliances, the cam or ratchet mechanism may be selectively advanced manually by the machine operator to a desired point in the cycle program prior to energizing the program timing motor.

Such cycle programming control mechanisms have found widespread use by virtue of their low initial cost, and ability to reliably switch relatively heavy currents such as the starting current associated with the appliance drum drive or pump motor. Thus, the electro-mechanical appliance programmer has maintained its popularity due to its low cost with respect to its ability to switch relatively high electrical currents.

Efforts to provide all-electronic timing control and switching functions for such appliance programmer have met with the difficulties in providing solid state switching devices capable of handling the necessary motor starting currents, yet operate from the low voltage direct current signals available from solid state logic circuits. Thus, although the electro-mechanical programmer timer is somewhat bulky and requires several moving parts, it has maintained its popularity as a low cost timing device capable of switching motor starting currents.

However, in appliances having electro-mechanical programmers it has been desired to find a way or means for the machine operator to selectively vary the time schedule of the program.

If an alternate or varied program schedule for the appliance is desired with an electro-mechanical timer, it is necessary to have an additional timing ratchet wheel and cams which may be engaged and prepositioned by the machine operator to provide the alternate program schedule. In order to provide such an alternate program schedule, the additional cost and complexity of the electro-mechanical timer has rendered such additional programming prohibitive in cost with respect to the design and manufacture of the programmer timer. Thus, it has been long desired to provide a simple yet low cost way of varying the program schedule of an electro-mechanical programmer timer without requiring additional cams or ratchets for each alternative schedule.

SUMMARY OF THE INVENTION

The present invention provides a method and means for providing a dwell or time delay for altering the schedule of an electro-mchanical programmer timer for use with appliances such as domestic dishwashers and clothes washing machines.

The present invention employs an electronic time delay circuit means operably connected to the appliance electro-mechanical programmer for providing intermittent dwell of the timing motor for predetermined time interval to thus delay the advance of the cycle programmer. The electronic time delay circuit means of the present invention thus provides for intermittent operation of the appliance timer motor with the dwell period having a predetermined length for providing an alternate appliance cycle program.

The present invention provides a time delay or dwell for an appliance programmer timing motor by counting the number of cycles of an alternating current power supplied to the timing motor and generating a first signal when the count reaches a number of cycles representative of a predetermined time lapse. The timing motor is permitted to run until the desired cycle count is reached at which time the motor is shut off. The present invention employs a twelve bit solid state counter which emits the first signal upon toggling of the eleventh bit of the counter. The counter toggles the twelfth bit to provide a second output signal upon the counter counting a number of cycles representing a time delay of twice that of the first signal. Switching logic is employed to shut off the appliance timing motor upon receipt of the first signal and maintain the timing motor in the off or dwell position for a time interval representative of a selected multiple of the time lapse associated with the first output signal.

The present invention thus employs electronic circuit means connected to an electro-mechanical programmer utilizing low voltage operated solid state switching devices to count the line current cycles and switch off the appliance programmer timing motor for selected time intervals to thereby add an additional or alternate program schedule for the appliance.

DETAILED DESCRIPTION

Figures 1, 2, 3:
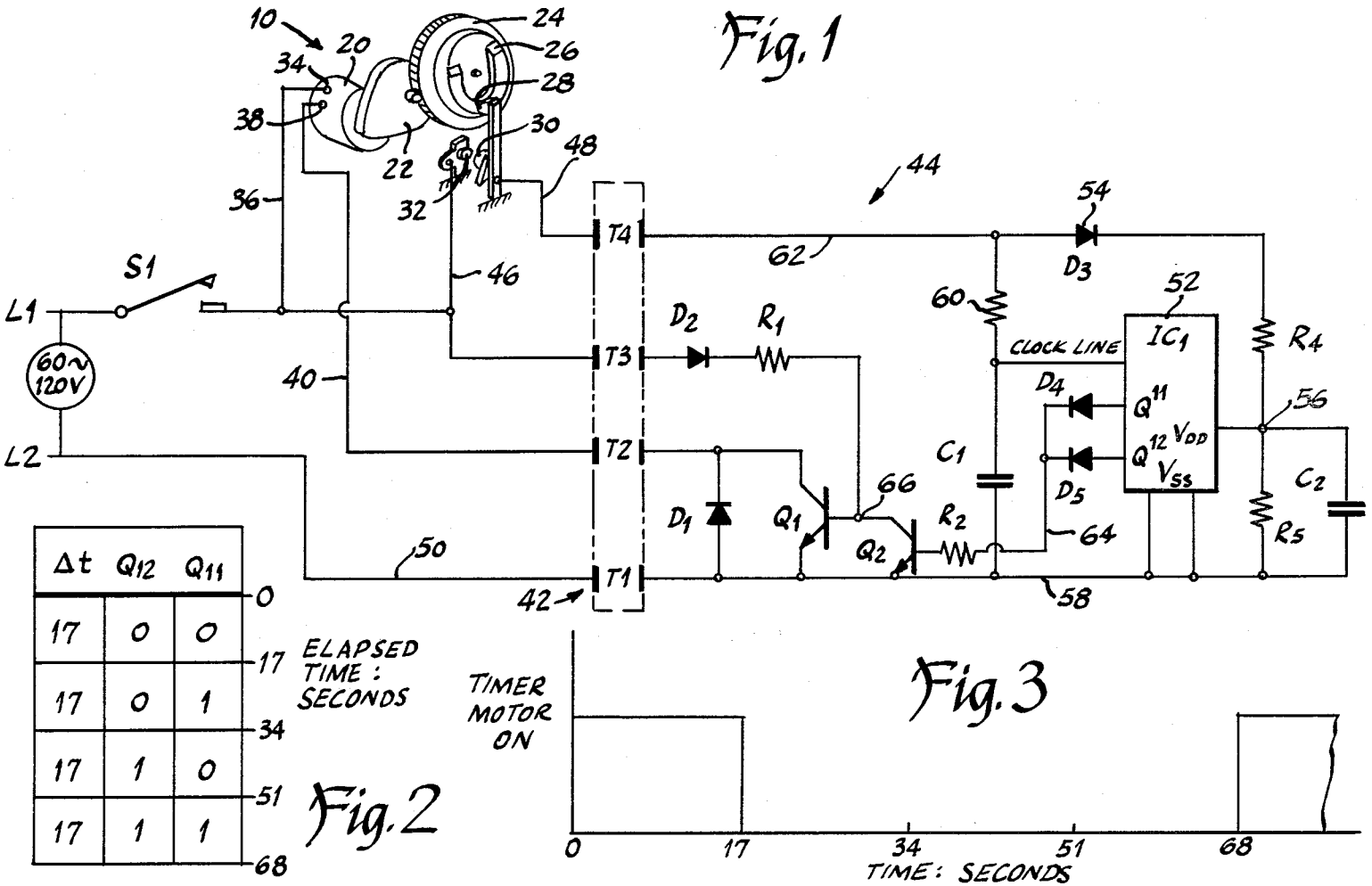
FIG. 1 is a schematic of the programmer timer and timing circuit means of the present invention.
FIG. 2 is a truth table for switching logic of the present invention.
FIG. 3 is a timing diagram for the operation of the electro-mechanical programmer timing motor.

Referring now to FIG. 1, an appliance programmer timer is illustrated somewhat schematically and denoted generally at 10 as including a timing motor 20 driving through a suitable speed reducer 22 a suitable advance mechanism such as cam wheel 24. Although wheel 24 is illustrated for simplicity as directly gear driven, it will be understood that any desired ratchet pawl or escapment mechanism may be employed if desired. Wheel 24 has a rotary cam 26 mounted on the face thereof which engages a cam follower 28 having mounted thereon a movable electrical contact 30. The corresponding stationary electrical contact 32 is disposed opposite the contact 30 for making and breaking a trigger circuit as will be hereinafter described in greater detail.

Timer motor 20 has one terminal 34 thereof connected via lead 36 through line switch S1 to one side L1 of an alternating current power source as for example 120 volt 60 cycle household current. The other terminal 38 of the timing motor 20 is connected via lead 40 to terminal T2 of an inline connector indicated generally at 42. Connector 42 interconnects the programmer 10, power line and the time delay or dwell circuit means indicated generally at 44.

Stationary contact 32 is connected via lead 46 to side L1 of the power line and terminal T3 of connector 42. Movable contact 30 is connected via lead 48 to terminal T4 of connector 42. Terminal T4 of connector 42 is thus in series with the switch contacts 32, 30 on side L1 of the power line; and, terminal T3 is connected directly to the side L1 of the power line. The timer motor 20 is thus in series with terminal T2 and side L1 of the power line. The neutral side L2 of the power line is connected via lead 50 to terminal T1 of connector 42.

The timing circuit 44 comprises a twelve-bit binary counter 52 which receives approximately ten-fifteen volts (10–15) through rectifier 54 and dropping resistor R4 through junction 56 at its input terminal $V_{DD}$. The ground input $V_{SS}$ of counter 52 is connected to lead 58 and thus to neutral side L2 of the power line. The clockline input of counter 52 is connected to terminal T4 via dropping resistor 60 and lead 62 for counting line current cycles. Capacitor C1 is connected from the clockline to neutral for averaging effects.

The eleventh bit output Q11 of the counter 52 and the twelfth bit output Q12 are connected respectively through "OR" diodes D4 and D5 through lead 60 to a dropping resistor R2 and to the base of a switching device Q2. The emitter of Q2 is connected to neutral line 58 and the collector is connected via junction 66 throug resistor R1 and reverse biased diode D2 to terminal D3 of connector 42.

Junction 66 is also connected to the base of switching device Q1 which has the emitter thereof connected to neutral lead 58 and the collector to terminal T2 of connector 42 and a reverse biased diode D1 is connected across the terminals T2 and T1 of connector 42 and is in parallel with the switching device Q1.

In operation, diode D1 acts as a half-wave rectifier preventing operation of motor 20; and, the motor can only operate when Q1 is switched on to connect terminal T2 to the neutral line T1 thus completing the circuit through motor 20 and powerlines L1 and L2.

Switch Q1 is operated by switch Q2 in such a manner that when switch Q2 is off Q1 conducts, thus permitting timer motor 20 to operate. When Q2 conducts, Q1 is switched off and operation of the timer motors ceases.

Switch Q2 is operated by a signal from either Q11 or Q12 from the twelve bit counter 52. Thus, an output signal from either Q11 or Q12 will cause Q2 to switch on and stop operation of the timer motor 20 and so long as a hi or logic one signal is present from timer 52, Q2 will remain switched on and the timer motor will remain off, or in the dwell position.

Referring now to FIGS. 2 and 3 wherein the truth table for the counter outputs and the timing diagram for the operation of timer motor 20 are illustrated, it is noted that the timer, in the preferred practice, runs for seventeen seconds then dwells for fifty-one seconds before resuming operation.

This schedule is accomplished upon closing of switch S1, by cam 26 closing the contacts 30 and 32 to power up terminal T4, and thus the clockline, and power supply junction 56 of the counter 52. The counter begins counting the sixty cycle line current and upon Q11 being toggled an output representing 1024 cycles (seventeen seconds) is provided to Q2 which is is switched on thus switching off Q1 and terminating operation of timer motor 20.

Upon passage of an additional seventeen seconds (2048 elapsed cycles) Q12 goes high and remains high for an additional 1024 cycles (seventeen seconds) representing a total elapsed time of fifty-one seconds. As Q12 goes high Q11 is reset to zero; and, with Q12 remaining high, Q11 counts an additional 1024 cycles (seventeen seconds) until resetting and resetting Q12 simultaneously therewith. Thus, Q11 and Q12 go low switching Q2 off and permitting Q1 to resume timer operation to begin the cycle over again.

It will thus be seen with reference to the foregoing description that the present invention provides a unique solid state electronic delay or dwell circuit means for altering the schedule of an electro-mechanical program timer usable for controlling the operational cycle of domestic washing appliances.

Although the invention has hereinabove been described with respect to the presently preferred practice, it will be apparent to those having ordinary skill in the art that the modifications and variations may be made without departing from the scope of the invention which is defined by the following claims.

I claim:

1. A cycle extender for a washing appliance having an electrical washing cycle timing control circuit, said cycle extender comprising:

(a) connector means including a first pair of terminals adapted for connection to an alternating current power source and a second pair of terminals adapted for connection to said timing circuit;

(b) counting means operable upon connection of said first terminal pair to said power source to count the number of said current cycles, said counting means being operable to provide an output on a first line upon counting a first predetermined number of said current cycles and operable to provide an output on a second line upon said count reaching a certain multiple of said predetermined number; and, (c) switching means operable upon receiving either the output on said first line or the output on said second line to break said timer circuit thereby disabling said timing circuit.

2. A method for providing a timing dwell in the operational cycle of a timer controlled appliance operating from a source of alternating current power or pulsed direct current power, comprising the steps of;

(a) counting an accumulated number of cycles of said power source and generating a first signal when said count reaches a number representing a desired lapsed time interval and generating a second signal upon occurrence of a predetermined multiple of said number; and, (b) switching off said timer in response to either of said first or second signals for providing a predetermined dwell in said timer operation.

3. A method of controlling the operational cycle timing of an appliance operating from a source of alternating current or pulsed direct current power comprising the steps of:

(a) providing a timer motor and at least one appliance cycle function switch operated by said timer;

(b) counting an accumulated number of cycles of said power source and generating a first signal when said count reaches a number representing a desired lapsed time interval and generating a second signal upon occurrence of a predetermined multiple of said number; and, (c) switching off said timer motor in response to either of said first or second signals for providing a dwell in said cycle timing.

4. A control system for an appliance of the type having a timer controlled program cycle and operative upon connection to a source of alternating current or pulsed direct current power, said control system comprising:

(a) programmer means operative upon connection to said power source and actuation to effect a preselected program of events in the appliance service cycle;

(b) timer means operative upon connection to said power source to effect actuation of said programmer means;

(c) counter means operable to count the passage of an accumulated number of cycles of said power current representing a preselected time interval and provide a first count signal on a first line, said counter means operable to provide a second count signal on a second line upon occurrence of a preselected multiple of said time interval; and, (d) switching circuit means operable upon receiving either said first count signal or said second count signal to disable said timer means for an integral multiple of said preselected time interval for thereby causing a desired dwell in said program cycle.

5. The system defined in claim 4, wherein said counter comprises a twelve bit binary counter.

6. The system defined in claim 5 wherein said counter comprises a twelve bit binary counter and said first signal line is the output of the eleventh bit and the second signal line is the output of the twelfth bit.

* * * * *

UNITED STATES PATENT AND TRADEMARK OFFICE

CERTIFICATE OF CORRECTION

PATENT NO. : 4,425,513

DATED : January 10, 1984

INVENTOR(S) : Thomas F. Glennon

It is certified that error appears in the above-identified patent and that said Letters Patent are hereby corrected as shown below:

On the title page, the assignee should read:

-- EATON CORPORATION --.

Signed and Sealed this

*Seventeenth* Day of *April 1984*

[SEAL]

*Attest:*

GERALD J. MOSSINGHOFF

*Attesting Officer*

*Commissioner of Patents and Trademarks*